US008540417B2

(12) United States Patent
Hasegawa

(10) Patent No.: US 8,540,417 B2
(45) Date of Patent: Sep. 24, 2013

(54) CHRONOGRAPH TIMEPIECE

(75) Inventor: Takanori Hasegawa, Chiba (JP)

(73) Assignee: Seiko Instruments Inc. (JP)

( * ) Notice: Subject to any disclaimer, the term of this patent is extended or adjusted under 35 U.S.C. 154(b) by 467 days.

(21) Appl. No.: 12/927,920

(22) Filed: Nov. 30, 2010

(65) Prior Publication Data

US 2011/0128826 A1 Jun. 2, 2011

(30) Foreign Application Priority Data

Dec. 1, 2009 (JP) ..... 2009-273643

(51) Int. Cl.
*G04F 7/00* (2006.01)
*G04F 8/00* (2006.01)

(52) U.S. Cl.
USPC ..... 368/106; 368/112

(58) Field of Classification Search
USPC ..... 368/106, 110–113
See application file for complete search history.

(56) References Cited

U.S. PATENT DOCUMENTS 3,691,753 A * 9/1972 Kurita ..... 368/156
3,817,024 A * 6/1974 Noguchi ..... 368/185
4,274,150 A * 6/1981 Ikenishi et al. ..... 368/185
4,623,260 A 11/1986 Kamiyama ..... 368/80
5,751,664 A * 5/1998 Higuchi et al. ..... 368/112
7,092,317 B2 * 8/2006 Ogasawara ..... 368/110
2011/0249536 A1 * 10/2011 Ogasawara et al. ..... 368/112

OTHER PUBLICATIONS

Patent Abstracts of Japan, publication No. 2006-090769, publication date Apr. 6, 2006.

* cited by examiner

*Primary Examiner* — Vit W Miska
(74) *Attorney, Agent, or Firm* — Adams & Wilks

(57) ABSTRACT

In a chronograph timepiece of a construction in which chronograph hands are electrically drive-controlled and mechanically zero-restoring-controlled, even when backlash is generated due to zero-restoring, the chronograph hands are normally moved at the time of the next time measurement start. A chronograph timepiece includes a drive control unit starting a time measurement operation in response to a start operation of a start/stop button, electrically hand-movement-driving chronograph hands by driving a chronograph hand movement motor according to the time measured, and resetting the time measurement operation in response to a reset operation of a reset button, and a mechanical structure mechanically zero-restoring and setting the chronograph hands in response to the reset operation, wherein the drive control unit drives the chronograph hand movement motor by a predetermined amount even after the reset operation has been performed.

16 Claims, 5 Drawing Sheets

CHRONOGRAPH TIMEPIECE

BACKGROUND OF THE INVENTION

1. Field of the Invention

The present invention relates to a chronograph timepiece having a time indicating function and a time measuring function.

2. Description of the Related Art

Conventionally, there has been developed a chronograph timepiece in which a plurality of motors are mounted to respectively drive a plurality of hands and which is equipped with a chronograph function that is, a time measuring function, in addition to a function to indicate time information as a basic function wherein the driving of the hands is effected electrically by the motors, with the zero-restoring of chronograph hands being effected by a mechanical structure such as a heart cam (See, for example, JP-A-61-73085 and JP-A-2006-90769).

In the related-art chronograph timepiece, stepping motors are used as the motors. As shown in FIG. 7, drive pulses of different polarities are alternately supplied to a section between a first terminal OUT1 and a second terminal OUT2 of a drive coil, whereby the motors are continuously rotated in a fixed direction. When a reset operation is performed on an operation unit, the driving by the drive pulses is stopped at that point in time, and the driving of the motors is stopped.

In this way, in the related-art chronograph timepiece, the driving of the motors is immediately stopped through the reset operation, so that, due to the cam zero-restoring at the time of reset operation, backlash is generated in a train wheel for transmitting the rotation of the motors to the chronograph hands. Thus, even when the cam zero-restoring is unlocked and drive pulses are output to thereby drive the motors at the time of the subsequent start operation, hand movement is not effected by an amount corresponding to the backlash, with the result that the hand movement operation of the chronograph hands is delayed.

SUMMARY OF THE INVENTION

It is an aspect of the present invention to provide a chronograph timepiece whose chronograph hands are electrically drive-controlled and mechanically zero-restoring-controlled, wherein even if backlash is generated due to the zero-restoring, the chronograph hands can be moved normally at the time of the next time measurement start.

According to the present invention, there is provided a chronograph timepiece including: a drive control unit starting a time measurement operation in response to a start operation of an operation unit, electrically hand-movement-driving a chronograph hand by driving a chronograph hand movement motor according to the time measured, and resetting the time measurement operation in response to a reset operation of the operation unit; and a mechanical structure mechanically zero-restoring and setting the chronograph hand in response to the reset operation, wherein, even after the reset operation is performed, the drive control unit drives the chronograph hand movement motor by a predetermined amount.

In the chronograph timepiece of the present invention which is of a construction in which the chronograph hand is electrically drive-controlled and mechanically zero-restoring-controlled, even if backlash is generated due to zero-restoring, it is possible to move the chronograph hand normally at the time of the next time measurement start.

DETAILED DESCRIPTION OF THE PREFERRED EMBODIMENTS

Figure 1:
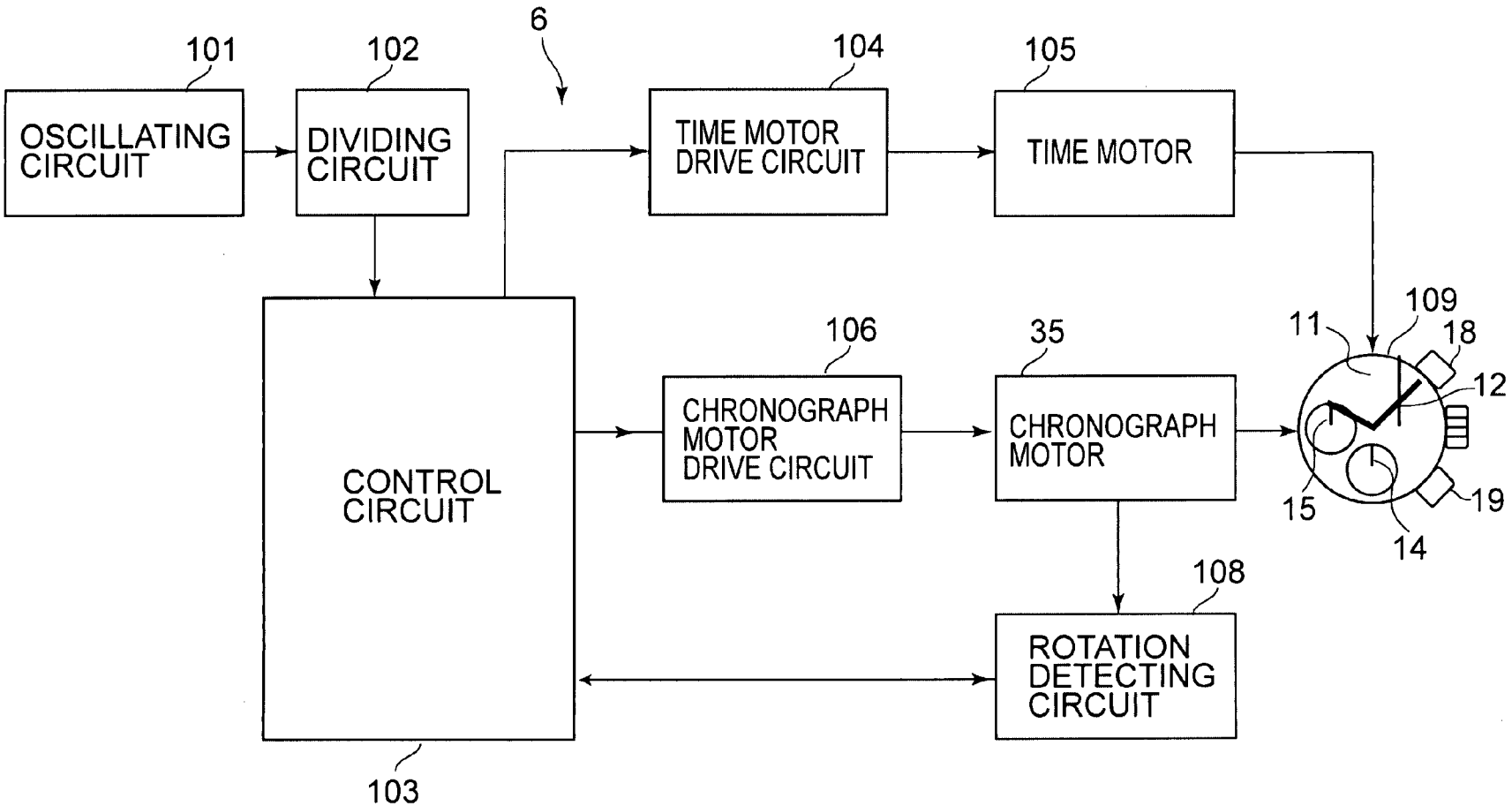
FIG. 1 is a block diagram illustrating the configuration of a chronograph timepiece according to a first embodiment of the present invention.
Figure 3:
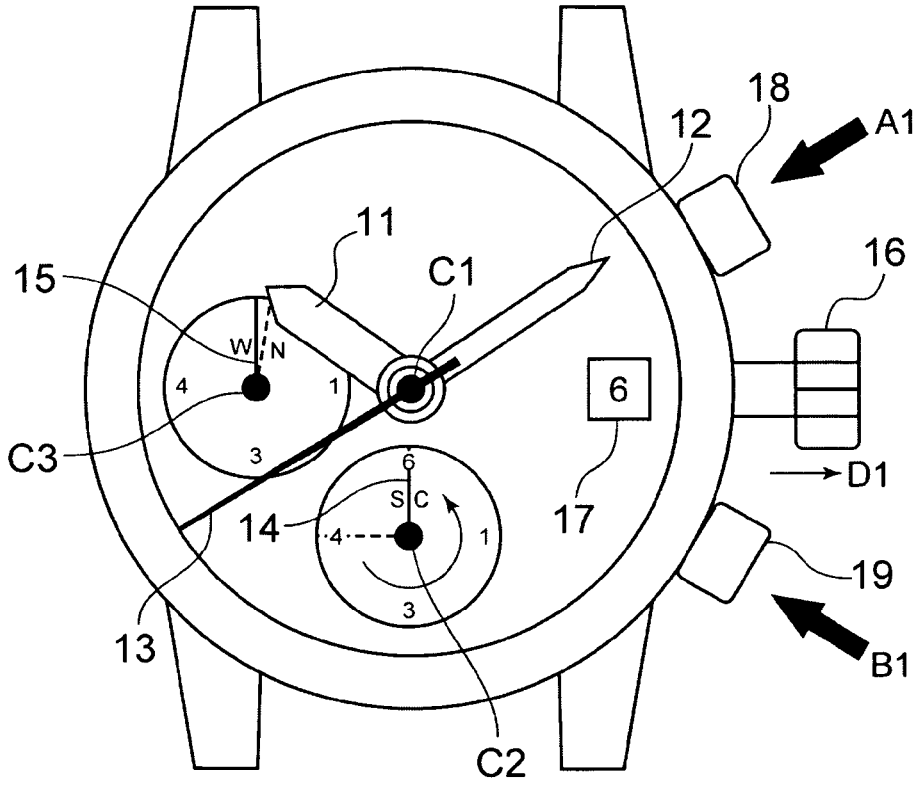
FIG. 3 is an external plan view of a chronograph timepiece according to an embodiment of the present invention.
Figure 4:
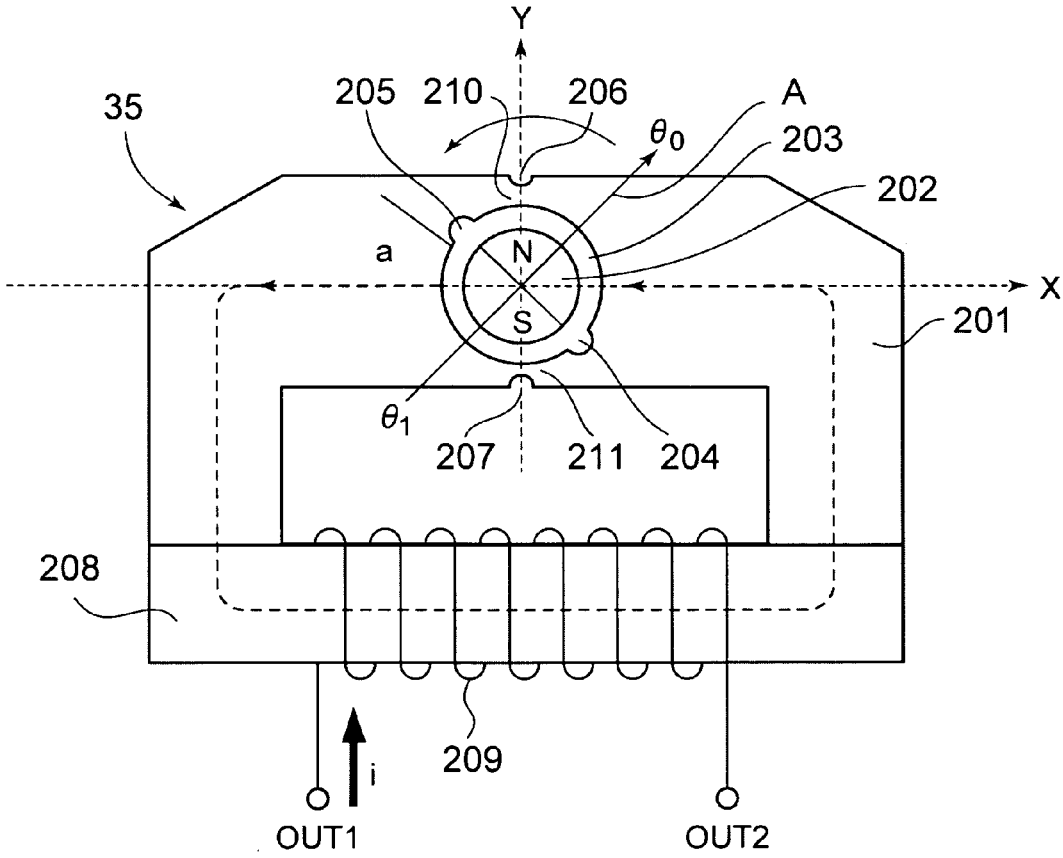
FIG. 4 is a schematic diagram illustrating the construction of a stepping motor used in a chronograph timepiece according to an embodiment of the present invention.
Figure 5:
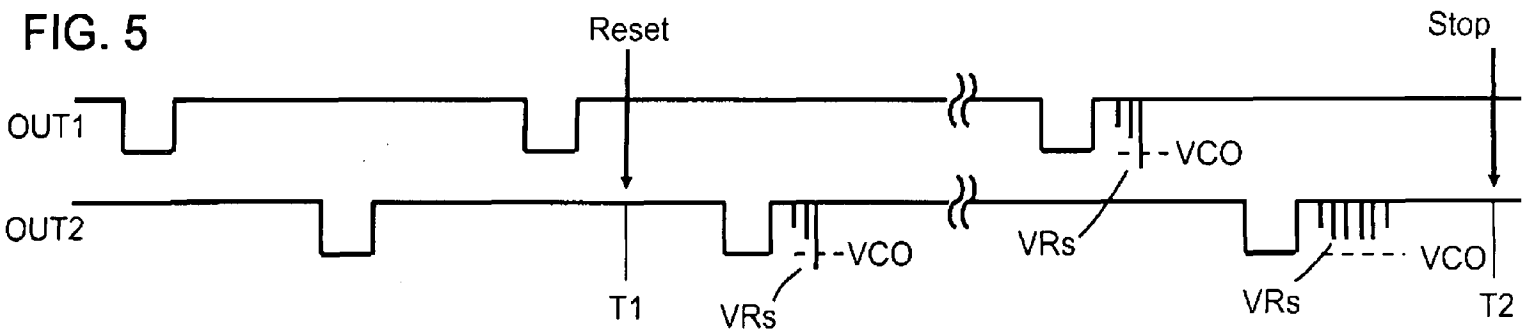
FIG. 5 is a timing chart for a chronograph timepiece according to the first embodiment of the present invention.
Figure 6:
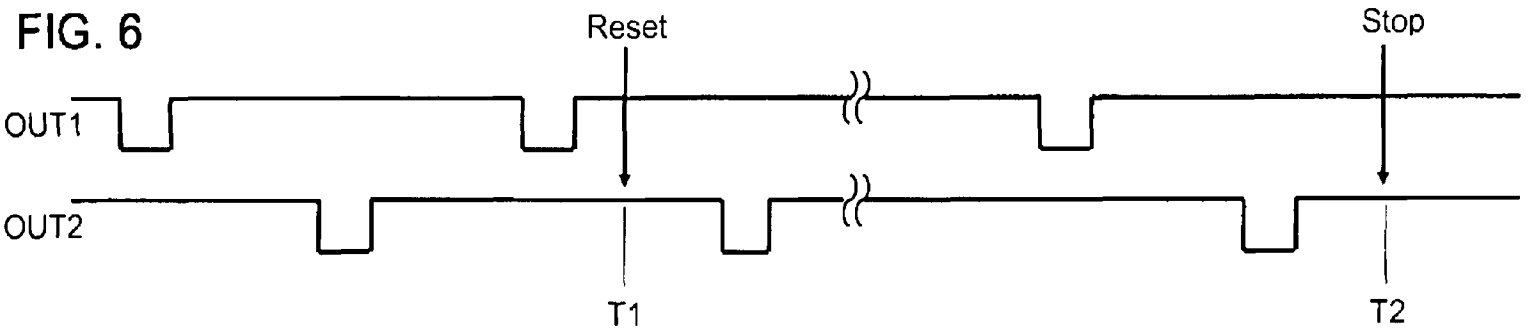
FIG. 6 is a timing chart for a chronograph timepiece according to a second embodiment of the present invention.
Figure 7:
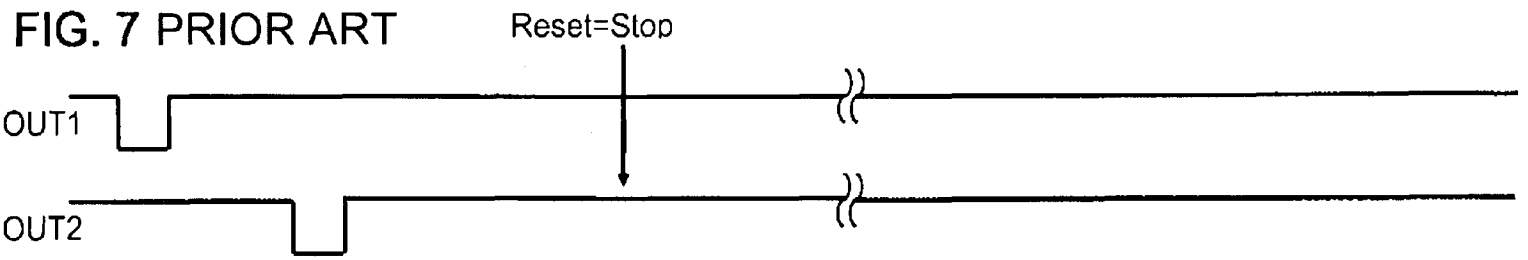
FIG. 7 PRIOR ART
FIG. 7 is a timing chart for a conventional chronograph timepiece.

In the following, a chronograph timepiece according to an embodiment of the present invention will be described with reference to the drawings. FIGS. 1 and 5 are diagrams illustrating the first embodiment of the present invention, FIG. 6 is a diagram illustrating the second embodiment of the present invention, and FIGS. 2 through 4 are diagrams common to the two embodiments. In the drawings, the same portions are indicated by the same reference numerals.

A chronograph timepiece 1 is a chronograph timepiece of a construction in which chronograph hands are electrically drive-controlled and mechanically zero-restoring-controlled. As shown in FIG. 3, the chronograph timepiece 1 is in the form of a wristwatch, and is equipped with time hands (an hour hand 11, a minute hand 12, and a second hand 13) rotated around a center axis C1 and indicating the current time, and is equipped with chronograph hands (a chronograph second hand 14 rotated around a center axis C2 and a chronograph minute hand 15 rotated around a center axis C3).

For example, by turning a winding stem 16 in a state in which it has been drawn out by two steps in a direction D1, it is possible to rotate the time hands 11 through 13, and by turning the winding stem 16 in a state in which it has been drawn out by one step in the direction D1, it is possible to change a date 17 of a date indicator displayed through a window. The operation of the chronograph timepiece 1 related to usual time indication is the same as that of an ordinary electronic timepiece and is well known by those skilled in the art, so that, in the following, a description of the structures, functions and operations related to the usual hand movement will be omitted.

In the chronograph timepiece 1, the chronograph hands 14 and 15 are electrically drive-controlled by a stepping motor, and are zero-restoring-controlled by a mechanical mechanism.

In the chronograph timepiece 1, by depressing a start/stop button 18 in a direction A1, an instruction is given to start or stop a chronograph operation (time measurement operation) by the chronograph timepiece 1. More specifically, the start/stop of the chronograph operation means the start/stop of the hand movement of the chronograph hands 14 and 15. As described below, in relation to this, there are effected the operation of an electrical drive system and the retention of electrical positional information on the chronograph hands.

In some cases, however, there is no need to retain the electrical positional information on the chronograph hands.

Further, in the chronograph timepiece 1, by depressing a reset button 19 in a direction B1, an instruction is given to reset the chronograph operation by the chronograph timepiece 1, that is, to restore (zero-restore) it to an initial state. More specifically, the reset of the chronograph operation means a forcible restoring (zero-restoring) of the chronograph hands 14 and 15 to the initial positions (time indicating positions), the setting of the hand movement of the chronograph hands 14 and 15, and the reset of the electrical positional information on the chronograph hands.

The start/stop button 18 and the reset button 19 constitute operation units.

First, a mechanical structure 5 and an operation related to the start, hand movement and zero-restoring of the chronograph timepiece 1 will be described mainly with reference to FIGS. 2A and 2B.

Apart from a time hand movement motor (time indicating motor) 105, the chronograph timepiece 1 is equipped with a chronograph hand movement motor (chronograph motor) 35; when it is rotated, the chronograph hand movement motor 35 moves the chronograph hands 14 and 15 via a chronograph hand movement train wheel 36.

The time hand movement motor 105 and the chronograph hand movement motor 35, whose constructions will be described below, are stepping motors generally used for timepieces. Each of the stepping motors has a stator having a rotor accommodation hole and a positioning portion determining a rotor stop position, a rotor arranged inside the rotor accommodation hole, and a drive coil; it rotates the rotor by generating a magnetic flux in the stator through supply of alternating signals (drive pulses) whose polarities are alternately different to the drive coil, and stops the rotor at a position corresponding to the positioning portion. Each time it is alternately driven drive pulses of different polarities, the rotor is rotated by a predetermined angle (e.g., 180 degrees) at one time; even if the driving is continuously effected with a plurality of in-phase drive pulses, when the rotation has been effected by the first drive pulse, no rotation is caused by the second in-phase drive pulse onward.

The chronograph timepiece 1 is equipped with a chronograph second cam 22 mounted to a chronograph second arbor 21 with the chronograph second hand 14 and a chronograph minute cam 24 mounted to a chronograph minute arbor 23 with the chronograph minute hand 15.

Further, the chronograph timepiece 1 is equipped with a hammer operating first lever (hereinafter also referred to as the "hammer operating lever B") 25, a hammer operating second lever (hereinafter also referred to as the "hammer operating lever A") 26, and a hammer 27.

The chronograph second cam 22, the chronograph minute cam 24, and the hammer 27 constitute a setting mechanism, and the hammer operating second lever 26 and the hammer 27 constitute a releasing unit. Further, the hammer operating second lever 26 and the hammer 27 also constitute a lever unit.

The hammer operating first lever 25 is rotatable between a reference position J1 (indicated by a solid line in FIG. 2B) and a zero-restoring position J2 (indicated by a solid line in FIG. 2A and by a dotted line in FIG. 2B), and a positioning pin 25*a* thereof is engaged with a spring-like positioning member 29 provided with an engagement groove, whereby positioning is effected at the reference position J1 or the zero-restoring position J2. An elongated hole 26*a* of the hammer operating second lever 26 is engaged with a pin 25*b* of the hammer operating first lever 25. When the hammer operating first lever 25 is moved from the reference position J1 to the zero-restoring position J2 and set in position, the hammer operating second lever 26 is moved from a reference position K1 (indicated by a solid line in FIG. 2B) to a zero-restoring position K2 (indicated by a solid line in FIG. 2A and by a dotted line in FIG. 2B).

On the other hand, when the hammer operating second lever 26 is moved from the zero-restoring position K2 to the reference position K1 and set in position, the hammer operating first lever 25 is moved from the zero-restoring position J2 to the reference position J1 and set in position.

Figure 2A:
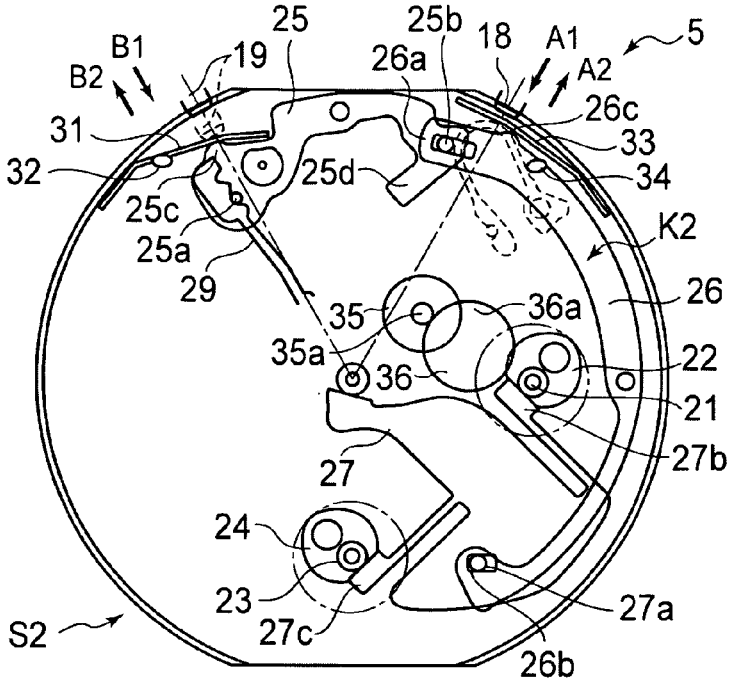
FIGS. 2A and 2B are schematic plan views illustrating the mechanical construction of a chronograph timepiece according to an embodiment of the present invention.
Figure 2B:
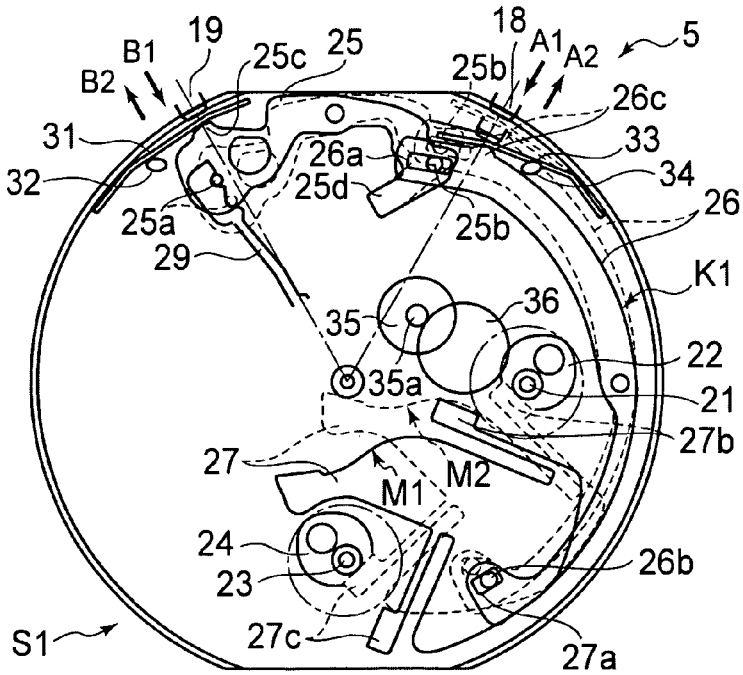

An elongated hole 27*a* of the hammer 27 is engaged with a pin 26*b* of the hammer operating second lever 26, and, according to the position setting of the hammer operating second lever 26 to the reference position K1 or the zero-restoring position K2, positioning is effected at a reference position M1 (indicated by a solid line in FIG. 2B) or at a zero-restoring position M2 (indicated by a solid line in FIG. 2A and by a dotted line in FIG. 2B).

When the hammer 27 is set at the zero-restoring position M2, a second hammer portion 27*b* of the hammer 27 strikes the chronograph second cam 22 to zero-restore the chronograph second hand 14 to the initial position, and a minute hammer portion 27*c* thereof strikes the chronograph minute cam 24 to zero-restore the chronograph minute hand 15 to the initial position.

When the chronograph timepiece 1 is in a zero-restoring (reset) state S2 shown in FIG. 2A, if the start/stop button 18 is depressed in the direction A1, a protrusion 26*c* of the hammer operating second lever 26 is pressed in the direction A1, and the lever 26 is displaced from the position K2 to the position K1 and, at the same time, the hammer operating first lever 25 is displaced from the position J2 to the position J1, and the hammer 27 is displaced from the position M2 to the position M1. As a result, the rotation setting (zero-restoring) of the heart cams 22 and 24 and the chronograph hands 14 and 15 by the hammer portions 27*b* and 27*c* is released. As a result, the mechanical structure 5 is restored to the state S1, and the chronograph hands 14 and 15 become rotatable.

On the other hand, when the chronograph timepiece 1 is in the start state or hand movement state S1 shown in FIG. 2B, if the reset button 19 is depressed in a direction B1, the protrusion 25*c* of the hammer operating first lever 25 is pressed in the direction B1, and the hammer operating first lever 25 is displaced from the position J1 to the position J2. When the hammer operating first lever 25 is displaced from the position J1 to the position J2, the hammer operating second lever 26 engaged with the lever 25 is moved from the position K1 to the position K2 on the one hand, and the hammer 27 engaged with the lever 26 is moved from the position M1 to the position M2, with the second hammer 27*b* and the minute hammer 27*c* striking the second heart 22 and the minute heart 24 to zero-restore the chronograph second hand 14 and the chronograph minute hand 15.

The electrical aspect of the chronograph timepiece 1 as far as it is related to the mechanical structure 5 shown in FIGS. 2A and 2B is as follows.

When the chronograph timepiece 1 is in the reset state S2 shown in FIG. 2A, if the start/stop button 18 is depressed in the direction A1, the start/stop button 18 presses a start/stop switch spring 33 exerting a biasing force in a direction A2 in the vicinity of the depth end thereof and closes a contact portion 34, generating a start signal Pa via the contact portion 34. When the chronograph timepiece 1 is in the start state S1 shown in FIG. 2B, if the start/stop button 18 is depressed in the direction A1, the start/stop button 18 presses the start/stop switch spring 33 and closes the contact portion 34, generating a stop signal Pb via the contact portion 34.

On the other hand, when the chronograph timepiece 1 is in the start state (or stop state) S1 shown in FIG. 2B, if the reset button 19 is depressed in the direction B1, the reset button 19 presses a reset switch spring 31 exerting a biasing force in a direction B2 in the vicinity of the depth end thereof and closes a contact portion 32, generating a reset signal Qa via the contact portion 32.

Of the above operations, the following more detailed description will center on the start and progress of the start operation when the start/stop button 18 is depressed in the direction A1 in the zero-restoring state S2 of FIG. 2A.

That is, as the start/stop button 18 is depressed in the direction A1, the electric start signal Pa is issued via the switch contact 34 on the one hand, whereby the chronograph hand movement motor 35 is rotated; on the other hand, through the rotation of the hammer 27 as a result of the rotation of the hammer operating second lever 26, the mechanical zero-restoring control state is released, and the hand movement is mechanically permitted (i.e., the mechanical setting is released).

As will be described in detail below, for the chronograph timepiece 1 to operate properly and for the time indication to be executed accurately, it is necessary for the rotor position of the chronograph hand movement motor 35 and the polarity of a drive pulse supplied from a motor drive circuit 53 to be matched with each other. In the chronograph timepiece 1, control is effected such that re-start is caused in a state in which the rotor position of the motor 35 and the polarity of the drive pulse supplied from the motor drive circuit 53 are matched with each other, whereby the chronograph hand movement motor 35 can be rotated reliably, thereby preventing generation of a state in which hand movement is impossible at the time of re-start of the chronograph operation.

Next, an electrical drive mechanism 6 of the chronograph timepiece 1 will be described mainly with reference to the block diagram of FIG. 1 while referring to the mechanical structure 5 of FIG. 2.

In FIG. 1, the chronograph timepiece 1 is equipped with an oscillation circuit 101 generating a signal of a predetermined frequency, a frequency divider circuit 102 effecting frequency division on the signal from the oscillation circuit 101 and outputting a timepiece signal serving as a reference for time indication and time measurement, a control circuit 103 performing a time indicating operation and a time measurement operation based on the timepiece signal and performing various control operations, a time motor drive circuit 104 rotating a time hand movement motor 105 in response to a time control signal from the control circuit 103, and a time hand movement motor 105 rotating the time hands 11 through 13 of an analog display unit 109.

Further, the chronograph timepiece 1 is equipped with a chronograph motor drive circuit 106 driving the chronograph hand movement motor 35 in response to a chronograph control signal from the control circuit 103, and the chronograph hand movement motor 35 rotating the chronograph hands 14 and 15 of the analog display unit 109.

Further, the chronograph timepiece 1 is equipped with the analog display unit 109 having the time hands 11 through 13 and the chronograph hands 14 and 15 and displaying time, measured time, etc., the start/stop button 18 giving an instruction to start and stop the time measurement operation, and the reset button 19 resetting the time measurement operation.

Here, the oscillation circuit 101, the frequency divider circuit 102, the control circuit 103, the time motor drive circuit 104, the chronograph drive circuit 106, and the rotation detection circuit 108 constitute a drive control unit. Further, the rotation detection circuit 108 constitutes a rotation detection unit.

The rotation of the chronograph hand movement motor 35 of the chronograph timepiece 1 is controlled by the control circuit 103 based on a time signal output through frequency division of an output signal from the oscillation circuit 101 by the frequency divider circuit 102.

The control circuit 103 performs time indicating operation based on a timepiece signal from the frequency divider circuit 102, and outputs a time control signal to the time motor drive circuit 104 at a predetermined time hand drive frequency, effecting control so as to drive the time hand movement motor 105. The time motor drive circuit 104 drives the time hand movement motor 105 in response to the time control signal. The time hands 13 through 15 of the analog display unit 109 are rotated by the time hand movement motor 105 to display the current time.

The start/stop button 18 and the reset button 19 are connected to the control circuit 103.

When time measurement (chronograph) operation is to be performed, the control circuit 103 performs time measurement based on the timepiece signal in response to the start operation of the start/stop button 18, and outputs a chronograph control signal to the chronograph motor drive circuit 106 at a predetermined chronograph hand drive cycle, effecting control so as to drive the chronograph hand movement motor 35. The chronograph drive circuit 106 drives the chronograph hand movement motor 35 in response to the chronograph control signal. The chronograph hands 14 and 15 of the analog display unit 109 are rotated by the chronograph hand movement motor 35 to display measured time whenever necessary.

The rotation detection circuit 108 detects an induction signal VRs generated by the chronograph hand movement motor 35 and detects the rotating condition of the chronograph hand movement motor 35. As will be described in detail below, the control circuit 103 effects the rotation control of the chronograph hand movement motor 35 based on the rotation detection result of the rotation detection circuit 108.

The control circuit 103 receives the start signal Pa imparted via the contact portion 34 in response to the depression of the start/stop button 18 (start operation) when the chronograph timepiece 1 is in the zero-restoring (reset) state S2. In response to the start signal Pa, the control circuit 103 starts time measurement operation based on the timepiece signal from the frequency divider circuit 102, and outputs a time control signal to the chronograph motor drive circuit 106 so as to rotate the chronograph hands 14 and 15 at a predetermined chronograph hand drive cycle.

In response to the time control signal, the time motor drive circuit 104 rotates the chronograph hand movement motor 35 alternately by drive signals of different polarities. The chronograph hand movement motor 35 is alternately driven by the drive pulses of different polarities to rotate in one direction by a predetermined angle at one time. As a result, the rotation of the chronograph hand movement motor 35 is transmitted to the chronograph hands 14 and 15 via the chronograph hand movement train wheel 36, and the chronograph hands 14 and 15 are moved.

Upon receiving the stop signal Pb imparted via the contact portion 34 in response to the depression of the start/stop button 18 (stop operation) when the chronograph timepiece 1 is in the start state S1, the control circuit 103 causes the chronograph motor drive circuit 106 to effect drive stop in response to the stop signal Pb, thereby stopping the time measurement operation. As a result, the rotation of the chronograph hand movement motor 35 is stopped, and the hand movement of the chronograph hands 14 and 15 via the chronograph hand movement train wheel 36 is stopped.

Upon receiving the reset signal Qa imparted via the contact portion 32 in response to the operation of the reset button 19 (reset operation) when the chronograph timepiece 1 is in the start state S1, the control circuit 103 resets the time measurement counter (not shown) inside the control circuit 103 to zero in response to the reset signal Qa, and causes the chronograph motor drive circuit 106 to effect drive stop, thereby resetting the time measurement operation. As a result, the rotation of the chronograph hand movement motor 35 is stopped, and the hand movement of the chronograph hands 14 and 15 via the chronograph hand movement train wheel 36 is stopped. Further, the chronograph hands 14 and 15 are zero-restored and set to predetermined positions by the mechanical structure 5.

FIG. 4 is a schematic view of the chronograph hand movement motor 35 used in an embodiment of the present invention; the drawing shows an example of a timepiece stepping motor generally used in analog electronic timepieces.

In FIG. 4, the stepping motor 35 is equipped with a stator 201 having a rotor accommodating through-hole 203, a rotor 202 rotatably arranged in the rotor accommodating through-hole 203, a magnetic core 208 joined to the stator 201, and a drive coil 209 wound around the magnetic core 208. When the stepping motor 105 is used in an analog electronic timepiece like the chronograph timepiece 1, the stator 201 and the magnetic core 208 are fixed to a main plate (not shown) by screws or swaging (not shown) to be joined to each other. The drive coil 209 has a first terminal OUT1 and a second terminal OUT2.

The rotor 202 is magnetized in two poles (S-pole and N-pole). At an outer end portion of the stator 201 formed of a magnetic material, there are provided a plurality of (two in this embodiment) cutouts (outer notches) 206 and 207 at positions opposed to each other, with the rotor accommodating through-hole 203 therebetween. Saturable portions 210 and 211 are provided between the outer notches 206 and 207 and the rotor accommodating through-hole 203. The saturable portions 210 and 211 are not magnetically saturated by the magnetic flux of the rotor 202; when the coil 209 is magnetized, they are magnetically saturated and are increased in magnetic resistance. The rotor accommodating through-hole 203 is formed as a circular hole in which a plurality of (two in this embodiment) semicircular cutouts (inner notches) 204 and 205 are integrally formed at opposing portions of the through-hole of a circular contour.

The cutouts 204 and 205 constitute positioning portions for determining the stop position of the rotor 202. As shown in FIG. 4, in a state in which the drive coil 209 is not magnetized, the rotor 202 is at rest in a stable fashion at a position corresponding to the positioning portions, in other words, at a position where the magnetic pole axis A of the rotor 202 is orthogonal to a segment connecting the cutouts 204 and 205 (i.e., a position where it makes an angle θ0 with respect to the direction X of the magnetic flux flowing through the stator 201).

When, in this state, a rectangular-wave drive pulse of one polarity (Here, it is assumed, for example, that the first terminal OUT1 side is a positive pole and that the second terminal OUT2 side is a negative pole) is supplied from the motor drive circuit 53 to a section between the terminal OUT1 and OUT2 of the drive coil 209, and an electric current (i) is passed in the direction of the arrow in FIG. 4, a magnetic flux is generated in the stator 201 in the direction of the dashed arrow line. As a result, the saturable portions 210 and 211 are saturated and the magnetic resistance is increased; after this, due to the mutual action between the magnetic poles generated in the stator 201 and the magnetic poles of the rotor 202, the rotor 202 rotates 180 degrees in the direction of the solid arrow line in FIG. 4, and stops in a stable manner at the position of an angle θ1.

Next, a rectangular-wave drive pulse of reversed polarity (This time, in order that the driving may be of reverse polarity, the first terminal OUT1 side is the negative pole, and the second terminal OUT2 side is the positive pole) is supplied from the motor drive circuit 53 to the terminals OUT1 and OUT2 of the drive coil 209, and an electric current is passed in the direction opposite to the arrow as shown in FIG. 4, then, a magnetic flux is generated in the stator 201 in the direction opposite to that of the dashed arrow line. As a result, the saturable portions 210 and 211 are first saturated, and then, due to the mutual action of the magnetic poles generated in the stator 201 and the magnetic poles of the rotor 202, the rotor 202 rotates 180 degrees in the same direction as in the above case, and stops in a stable manner at the position of the angle θ0.

From this onward, drive pulses of different polarities (alternating signals) are supplied to the drive coil 209, whereby the above operations are repeatedly performed, making it possible to continuously rotate the rotor 202 in the direction of the solid arrow line by 180 degrees at one time. Ina case where the driving is successively effected with drive pulses of the same polarity, the rotor 202 is not rotated by the second drive pulse of the same polarity onward; as described above, continuous rotation is possible through alternate driving with drive pulses of different polarities.

FIG. 5 is a timing chart related to the chronograph timepiece 1 of the first embodiment of the present invention.

Regarding the chronograph timepiece 1 of the first embodiment, constructed as described above, mainly the operation when the reset operation is performed by the reset button 19 will be described with reference to FIGS. 1 through 5.

When the chronograph timepiece 1 is in the reset state S2 shown in FIG. 2A, if the start/stop button 18 is depressed in the direction A1 to perform start operation, the control circuit 103 starts time measurement based on a timepiece signal from the frequency divider circuit 102, and a chronograph control signal is output to the chronograph motor drive circuit 106 at the chronograph hand drive frequency, effecting control so as to drive the chronograph hand movement motor 35.

As shown in FIG. 5, in response to the chronograph control signal, the chronograph drive circuit 106 supplies drive pulses of alternately different polarities to the section between the first terminal OUT1 and the second terminal OUT2 of the chronograph hand movement motor 35 to drive the motor. The chronograph hands 14 and 15 of the analog display unit 109 are rotated by the chronograph hand movement motor 35, and the measured time is displayed whenever necessary.

On the other hand, when the chronograph timepiece 1 is in the start state or hand movement state S1 shown in FIG. 2B, if, at the point in time T1 of FIG. 5, the reset button 19 is depressed in the direction B1 to perform reset operation, the protrusion 25*c* of the hammer operating first lever 25 is pressed in the direction B1, and the hammer operating first lever 25 is displaced from the position J1 to the position J2. When the hammer operating first lever 25 is displaced from the position J1 to the position J2, the hammer operating second lever 26 engaged with the lever 25 is moved, on the one hand, from the position K1 to the position K2, and the hammer 27 engaged with the lever 26 is moved from the position M1 to the position M2, with the second hammer 27*b* and the minute hammer 27*c* striking the second heart cam 22 and the minute heart cam 24 to zero-restore and set the chronograph second hand 14 and the chronograph minute hand 15. As a result, the chronograph timepiece 1 is restored to the reset state S2 of FIG. 2A.

Further, in response to the reset operation, the control circuit 103 controls the chronograph drive circuit 106 such that the chronograph hand movement motor 35 is driven by a previously determined amount and then stopped. That is, in response to the reset operation, the control circuit 103 supplies the chronograph control signal to the chronograph motor drive circuit 106 so as to rotate the chronograph hand movement motor 35 a predetermined number of times until the point in time T2, when rotation of the chronograph hand movement motor 35 through the mechanical zero-restoring operation is impossible. In this case, it ought to be impossible for the chronograph hand movement motor 35 to be rotated through the above-described mechanical zero-restoring operation; however, due to the presence of backlash in the chronograph hand movement train wheel 36, the chronograph hand movement motor 35 is rotated a predetermined number of times until the backlash is run out (i.e., until the point in time T2).

In the first embodiment, in order to drive the motor by the predetermined amount, in response to the reset operation, the control circuit 103 determines whether the chronograph hand movement motor 35 has rotated or not based on the rotation detection result of the rotation detection circuit 108 each time the chronograph hand movement motor 35 is driven, controlling the chronograph motor drive circuit 106 so as to effect the rotation drive until the chronograph hand movement motor 35 ceases to rotate (i.e., until the point in time T2).

In the example of FIG. 5, the control circuit 103 judges the motor to be in a rotation state when, after the time measurement operation is reset, the rotation detection circuit 108 detects that the induction signal VRs generated immediately after the driving by each drive pulse has exceeded a predetermined reference threshold voltage Vcomp, and judges the motor to be in a non-rotation state when the rotation detection circuit 108 detects that the induction signal VRs has not exceeded the predetermined reference threshold voltage Vcomp.

The control circuit 103 stops the driving at the point in time T2 when the chronograph hand movement motor 35 is judged to be in the non-rotation state. Thus, the chronograph control circuit 106 performs rotation drive until the backlash is run out and the chronograph hand movement motor 35 ceases to rotate. When the chronograph hand movement motor 35 has been driven until it ceases to rotate, the control circuit 103 stores, in a storage unit (not shown) inside it, the polarity of the drive pulse with which the driving has been effected the last time as information (drive pulse polarity information) for determining the polarity of the drive pulse with which the driving is to be effected at the time of the next time measurement start. The drive pulse polarity information is information for determining the polarity of the drive pulse with which the driving is to be started at the time of the next time measurement start based on the polarity of the drive pulse with which the driving has been effected the last time.

Next, when the chronograph timepiece is in the reset state S2 of FIG. 2A, if start operation is performed again on the start/stop button 18, in response to the start operation the control circuit 103 controls the chronograph motor drive circuit 106 so as to start driving with a drive pulse of a polarity reverse to the polarity stored referring to the drive pulse polarity information stored in the storage unit. The chronograph drive circuit 106 drives the chronograph hand movement motor 35 with the drive pulse of a polarity reverse to the polarity stored in the storage unit.

The chronograph hand movement motor 35 is a stepping motor rotated by being alternately driven with drive pulses of different polarities; since it is driven with a drive pulse of a polarity different from that of the previous drive, it can be rotated in a normal fashion. Further, even if backlash is generated due to the zero-restoring, the driving is stopped in a state in which the backlash has been run out, and the chronograph hand movement motor 35 can be reliably rotated at the time of the next time measurement start, so that the chronograph hands can be moved in the normal fashion.

While in the above-described example, the polarity of the drive pulse with which the driving has been effected the last time is stored as the drive pulse polarity information in the storage unit, it is also possible to store the polarity of the drive pulse with which the driving is to be effected next. In this case, in response to the next start operation, the chronograph motor drive circuit 106 is controlled so as to start driving with a drive pulse of the polarity stored in the storage unit; also in this case, the chronograph motor drive circuit 106 controls the chronograph hand movement motor 35 with a drive pulse of a polarity reverse to that of the drive pulse with which the driving has been effected the last time, so that the motor can be normally rotated to effect hand movement.

FIG. 6 is a timing chart for a chronograph timepiece 1 according to a second embodiment of the present invention. The second embodiment differs from the first embodiment in that the drive timing is as shown in FIG. 6 instead of being as shown in FIG. 5, and that there is no need to provide the rotation detection circuit 108 shown in FIG. 1; otherwise, it is of the same construction and operation as the first embodiment. In the following, the difference of the second embodiment from the first embodiment will be described mainly with reference to FIG. 6.

When reset operation is performed by the reset button 19 at the point in time T1 during time measurement operation, the control circuit 103 controls the chronograph drive circuit 106, in response to the reset operation, so as to stop the driving at the point in time T2 after the chronograph hand movement motor 35 has been rotated by a predetermined amount.

The above-mentioned predetermined amount is set to a rotation amount allowing the backlash to be run out. Further, the predetermined amount can be the number of times that the driving is effected which makes it possible to run out the backlash.

As in the first embodiment, in the second embodiment also, drive pulse polarity information is stored in the storage unit.

Next, when the chronograph timepiece is in the reset state S2 of FIG. 2A, if start operation is performed again on the start/stop button 18, the control circuit 103 controls, in response to the start operation, the chronograph motor drive circuit 106, with reference to the drive pulse polarity information stored in the storage unit, so as to start driving with a drive pulse of a polarity reverse to that of the drive pulse with which driving has been effected the last time. The chronograph motor drive circuit 106 starts the rotation-drive of the chronograph hand movement motor 35 with a drive pulse of a polarity reverse to that of the drive pulse with which the driving has been effected the last time.

As a result, it is possible to rotate the chronograph hand movement motor 35 in the normal fashion. Further, it is possible to stop the driving with backlash run out, and to reliably rotate the chronograph hand movement motor 35 at the time of the next time measurement start, so that it is possible to move the chronograph hands in the normal fashion.

As described above, according to the above embodiments of the present invention, there is provided a chronograph timepiece 1 including a drive control unit starting a time measurement operation in response to a start operation of an operation unit, electrically hand-movement-driving chronograph hands 14 and 15 by driving a chronograph hand movement motor 35 according to the time measured, and resetting the time measurement operation in response to a reset operation of the operation unit; and a mechanical structure 5 mechanically zero-restoring the chronograph hands 14 and 15 in response to the reset operation, wherein the drive control unit drives the chronograph hand movement motor 35 by a predetermined amount even after the reset operation has been performed.

If the above-mentioned predetermined amount is set to a number of times of driving that allows backlash of the train wheel 36 to be completely run out, it is possible to completely eliminate abnormality in hand movement due to the backlash; however, in a case where it suffices to suppress abnormality in hand movement to some degree, the predetermined amount may be set to a number of times of driving less than the above-mentioned number of times of driving.

When the predetermined amount is a driving amount allowing the backlash to be completely run out, it is possible, as in the first embodiment, to adopt the above-mentioned predetermined amount and to effect rotation drive until the rotation detection circuit 108 detects that the chronograph hand movement motor 35 has ceased to rotate.

Further, as in the above-described embodiments, there is stored drive pulse polarity information for determining the polarity of the drive pulse with which driving is to be effected at the time of the next time measurement start based on the polarity of the drive pulse with which the driving has been effected the last time, and, referring to the drive pulse polarity information in response to the next start operation, the chronograph hand movement motor 35 is started to be driven with a drive pulse of a polarity reverse to that of the drive pulse with which the driving has been effected the last time by the predetermined amount, whereby it is possible to reliably start hand movement at the time of time measurement start.

Regarding the drive pulses for the chronograph hand movement motor 35, the drive pulses at the time of usual chronograph hand movement drive and the drive pulses with which driving is effected after the reset operation may be drive pulses of the same energy or drive pulses of differing energy.

The present invention is applicable to various types of chronograph timepieces in which driving of the time hands and the chronograph hands is effected electrically by motors, and in which, in the reset state, setting is effected by a mechanical mechanism such that the chronograph hands do not move, with the driving of the chronograph hands being effected after the releasing of the setting by the mechanical mechanism.

What is claimed is:

1. A chronograph timepiece comprising: a drive control unit starting a time measurement operation in response to a start operation of an operation unit, electrically hand-movement-driving a chronograph hand by driving a chronograph hand movement motor according to the time measured, and resetting the time measurement operation in response to a reset operation of the operation unit; and a mechanical structure mechanically zero-restoring and setting the chronograph hand in response to the reset operation, wherein, even after the reset operation is performed, the drive control unit drives the chronograph hand movement motor by a predetermined amount.

2. A chronograph timepiece according to claim 1, wherein the drive control unit drives the chronograph hand movement motor a predetermined number of times as the predetermined amount.

3. A chronograph timepiece according to claim 1, further comprising a train wheel transmitting the rotation of the chronograph hand movement motor to the chronograph hand, wherein the predetermined amount is a rotation drive amount until backlash of the train wheel is run out.

4. A chronograph timepiece according to claim 2, further comprising a train wheel transmitting the rotation of the chronograph hand movement motor to the chronograph hand, wherein the predetermined amount is a rotation drive amount until backlash of the train wheel is run out.

5. A chronograph timepiece according to claim 1, wherein the drive control unit has a rotation detection unit detecting a rotating condition of the chronograph hand movement motor, with the chronograph hand movement motor being driven by the predetermined amount until the rotation detection unit detects that the chronograph hand movement motor has ceased to rotate.

6. A chronograph timepiece according to claim 2, wherein the drive control unit has a rotation detection unit detecting a rotating condition of the chronograph hand movement motor, with the chronograph hand movement motor being driven by the predetermined amount until the rotation detection unit detects that the chronograph hand movement motor has ceased to rotate.

7. A chronograph timepiece according to claim 3, wherein the drive control unit has a rotation detection unit detecting a rotating condition of the chronograph hand movement motor, with the chronograph hand movement motor being driven by the predetermined amount until the rotation detection unit detects that the chronograph hand movement motor has ceased to rotate.

8. A chronograph timepiece according to claim 4, wherein the drive control unit has a rotation detection unit detecting a rotating condition of the chronograph hand movement motor, with the chronograph hand movement motor being driven by the predetermined amount until the rotation detection unit detects that the chronograph hand movement motor has ceased to rotate.

9. A chronograph timepiece according to claim 1, wherein the chronograph hand movement motor is a stepping motor rotated by being alternately driven by drive pulses of different polarities; and the drive control unit has a storage unit storing drive pulse polarity information for determining the polarity of the drive pulse with which driving is to be effected at the time of the next time measurement start based on the polarity of the drive pulse with which driving has been effected the last time, and, referring to the drive pulse polarity information stored in the storage unit in response to the next start operation, starts to drive the chronograph hand movement motor with a drive pulse of a polarity reverse to that of the last drive pulse when driving has been effected the last time by the predetermined amount.

10. A chronograph timepiece according to claim 2, wherein the chronograph hand movement motor is a stepping motor rotated by being alternately driven by drive pulses of different polarities; and the drive control unit has a storage unit storing drive pulse polarity information for determining the polarity of the drive pulse with which driving is to be effected at the time of the next time measurement start based on the polarity of the drive pulse with which driving has been effected the last time, and, referring to the drive pulse polarity information stored in the storage unit in response to the next start operation, starts to drive the chronograph hand movement motor with a drive pulse of a polarity reverse to that of the last drive pulse when driving has been effected the last time by the predetermined amount.

11. A chronograph timepiece according to claim 3, wherein the chronograph hand movement motor is a stepping motor rotated by being alternately driven by drive pulses of different polarities; and the drive control unit has a storage unit storing drive pulse polarity information for determining the polarity of the drive pulse with which driving is to be effected at the time of the next time measurement start based on the polarity of the drive pulse with which driving has been effected the last time, and, referring to the drive pulse polarity information stored in the storage unit in response to the next start operation, starts to drive the chronograph hand movement motor with a drive pulse of a polarity reverse to that of the last drive pulse when driving has been effected the last time by the predetermined amount.

12. A chronograph timepiece according to claim 4, wherein the chronograph hand movement motor is a stepping motor rotated by being alternately driven by drive pulses of different polarities; and the drive control unit has a storage unit storing drive pulse polarity information for determining the polarity of the drive pulse with which driving is to be effected at the time of the next time measurement start based on the polarity of the drive pulse with which driving has been effected the last time, and, referring to the drive pulse polarity information stored in the storage unit in response to the next start operation, starts to drive the chronograph hand movement motor with a drive pulse of a polarity reverse to that of the last drive pulse when driving has been effected the last time by the predetermined amount.

13. A chronograph timepiece according to claim 5, wherein the chronograph hand movement motor is a stepping motor rotated by being alternately driven by drive pulses of different polarities; and the drive control unit has a storage unit storing drive pulse polarity information for determining the polarity of the drive pulse with which driving is to be effected at the time of the next time measurement start based on the polarity of the drive pulse with which driving has been effected the last time, and, referring to the drive pulse polarity information stored in the storage unit in response to the next start operation, starts to drive the chronograph hand movement motor with a drive pulse of a polarity reverse to that of the last drive pulse when driving has been effected the last time by the predetermined amount.

14. A chronograph timepiece according to claim 6, wherein the chronograph hand movement motor is a stepping motor rotated by being alternately driven by drive pulses of different polarities; and the drive control unit has a storage unit storing drive pulse polarity information for determining the polarity of the drive pulse with which driving is to be effected at the time of the next time measurement start based on the polarity of the drive pulse with which driving has been effected the last time, and, referring to the drive pulse polarity information stored in the storage unit in response to the next start operation, starts to drive the chronograph hand movement motor with a drive pulse of a polarity reverse to that of the last drive pulse when driving has been effected the last time by the predetermined amount.

15. A chronograph timepiece according to claim 7, wherein the chronograph hand movement motor is a stepping motor rotated by being alternately driven by drive pulses of different polarities; and the drive control unit has a storage unit storing drive pulse polarity information for determining the polarity of the drive pulse with which driving is to be effected at the time of the next time measurement start based on the polarity of the drive pulse with which driving has been effected the last time, and, referring to the drive pulse polarity information stored in the storage unit in response to the next start operation, starts to drive the chronograph hand movement motor with a drive pulse of a polarity reverse to that of the last drive pulse when driving has been effected the last time by the predetermined amount.

16. A chronograph timepiece according to claim 8, wherein the chronograph hand movement motor is a stepping motor rotated by being alternately driven by drive pulses of different polarities; and the drive control unit has a storage unit storing drive pulse polarity information for determining the polarity of the drive pulse with which driving is to be effected at the time of the next time measurement start based on the polarity of the drive pulse with which driving has been effected the last time, and, referring to the drive pulse polarity information stored in the storage unit in response to the next start operation, starts to drive the chronograph hand movement motor with a drive pulse of a polarity reverse to that of the last drive pulse when driving has been effected the last time by the predetermined amount.

* * * * *